US006398151B1

(12) United States Patent
Tam

(10) Patent No.: US 6,398,151 B1
(45) Date of Patent: Jun. 4, 2002

(54) TOILET TISSUE ANTI-ROLL INSERT

(76) Inventor: Isaac Y. Tam, 470 Americano Way, Fairfield, CA (US) 94533

( * ) Notice: Subject to any disclaimer, the term of this patent is extended or adjusted under 35 U.S.C. 154(b) by 0 days.

(21) Appl. No.: 09/899,033

(22) Filed: Jul. 6, 2001

(51) Int. Cl.[7] ..... B65H 23/08
(52) U.S. Cl. ..... 242/422.5
(58) Field of Search ..... 242/422.5, 422.4, 242/156.1

(56) References Cited

U.S. PATENT DOCUMENTS 1,391,326 A * 9/1921 Killian ..... 242/422.5
3,061,218 A * 10/1962 Moore ..... 242/422.5
3,291,354 A * 12/1966 Ziebarth ..... 242/422.5
3,709,445 A * 1/1973 Adams ..... 242/422.5
3,918,661 A * 11/1975 Kishi et al. ..... 242/422.5
4,285,474 A * 8/1981 Perez ..... 242/156.1
4,381,083 A * 4/1983 Tsunetsugu ..... 242/422.5
4,556,160 A * 12/1985 Kurz et al. ..... 242/422.5
4,667,891 A * 5/1987 Pool ..... 242/156.1
4,771,966 A * 9/1988 Anderson ..... 242/422.5
4,832,271 A * 5/1989 Geleziunas ..... 242/422.5

* cited by examiner

*Primary Examiner*—William A. Rivera

(57) ABSTRACT

A toilet tissue anti-roll device is disclosed. The device is to be inserted behind a tissue roll in the space between the tissue and the wall. The device has a main body. The main body extends upward to form a top anchor, and extends downward to form a bottom anchor. There are left and right hooks attached to the main body. The left and right hooks hang the device onto the tissue roll and impart friction on it to prevent it from rolling out of control. The top and bottom anchors prevent the device from rolling with the tissue roll.

3 Claims, 4 Drawing Sheets

TOILET TISSUE ANTI-ROLL INSERT

BACKGROUND—FIELD OF INVENTION

This invention is related to friction generators that generate friction to the toilet tissue roll so that the tissue roll will not roll out of control when its tissue is pulled and torn off by a user.

BACKGROUND—PRIOR ART

Heretofore a conventional toilet tissue roll holder has no mechanism to retard the rolling motion of the tissue roll. When the tissue roll is full, due to its inertia, it will not get into excessive rolling motion when its tissue is pulled and torn off. But when the tissue is gradually used up, the inertia becomes less and less, and it can easily roll out of control. To prevent this from happening, a user has to use one hand to hold the tissue roll and use the other hand to pull and tear the tissue. This is quite often found to be bothersome to have to use both hands.

In the past some inventors suggested some methods to counter this shortcoming by manipulating the spindle to impart some inertia to the tissue roll, exemplified by the invention by Peterson, U.S. Pat. No. 4,447,015, entitled Toilet Tissue Dispensing Device. This method involves complicated mechanisms to link the tissue roll to a massive spindle so that the inertia of the spindle will retard the excessive movements of the tissue roll. This method is expensive to implement, and it does not provide a consistent effect to the tissue roll, because when the tissue roll is full it still has a lot more inertia than when the roll is almost empty.

OBJECTS OF THE INVENTION

It is an object of this invention to provide a device that prevents a toilet tissue roll from rolling out of control, so that a user does not have to hold on to the tissue roll with one hand, and pull and tear the tissue with the other, making the tissue roll one-hand operable.

It is another object of this invention to provide a device that is very easy to use. To use the device, a user is simply to drop the device behind the tissue roll in the space between the tissue roll and the wall where the tissue roll is mounted.

It is still another object of this invention to provide a device that imparts a same anti-roll effect to a tissue roll whether the tissue roll is full or is almost empty.

It is still another object of this invention to provide a very simple device that is very easy to manufacture.

SUMMARY OF THE INVENTION

This invention is a simple device that prevents a toilet tissue roll from rolling out of control by imparting friction to the tissue roll. This device is to be inserted behind a tissue roll, in the space between the tissue roll and the wall where the tissue roll is mounted. It has a main body that supports a top anchor, a bottom anchor, and some hooks. The function of the top anchor and the bottom anchor is to prevent the device from rolling with the tissue. The hooks are to hang the device on the tissue roll and to impart friction on it.

DETAILED DESCRIPTION OF THE INVENTION

Figure 1:
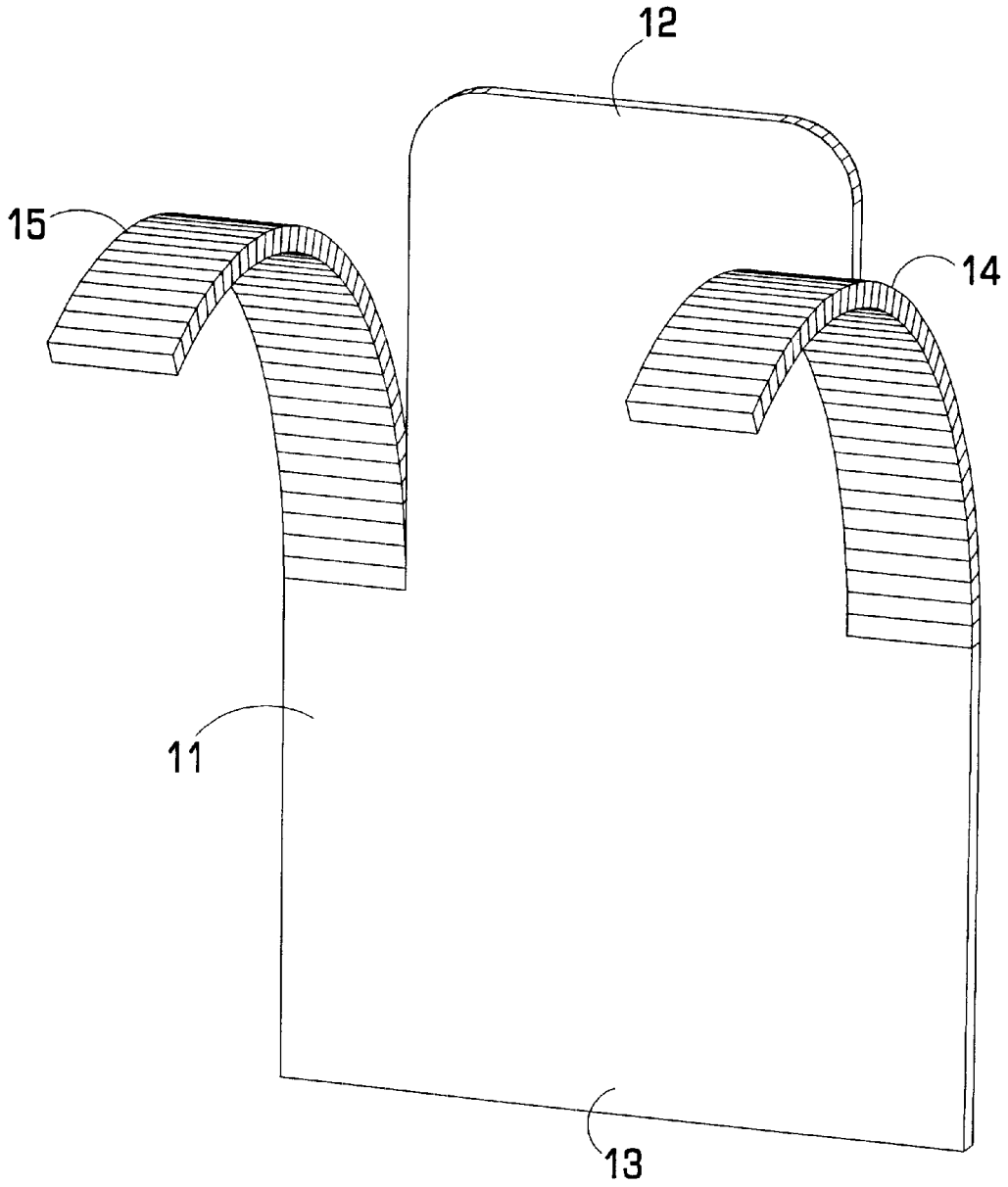
FIG. 1 is a perspective view of a preferred embodiment of the invention.

FIG. 1 perspectively shows a preferred embodiment made of fairly rigid material such as a rigid type of plastic, wherein 11 is a main body, 12 is a top anchor, 13 is a bottom anchor, 14 is a right hook, and 15 is a left hook. Main body 11, top anchor 12, and bottom anchor 13 are all in a same flat board with top anchor 12 on one end and bottom anchor 13 on the other end in opposition to top anchor 12. Left hook 15 and right hook 14 are strips of a same material as that in main body 11, with one end fixedly mounted on main body 11, in an area in between top anchor 12 and bottom anchor 13, and the other end bent forward and downward to form a hook.

Figure 2:
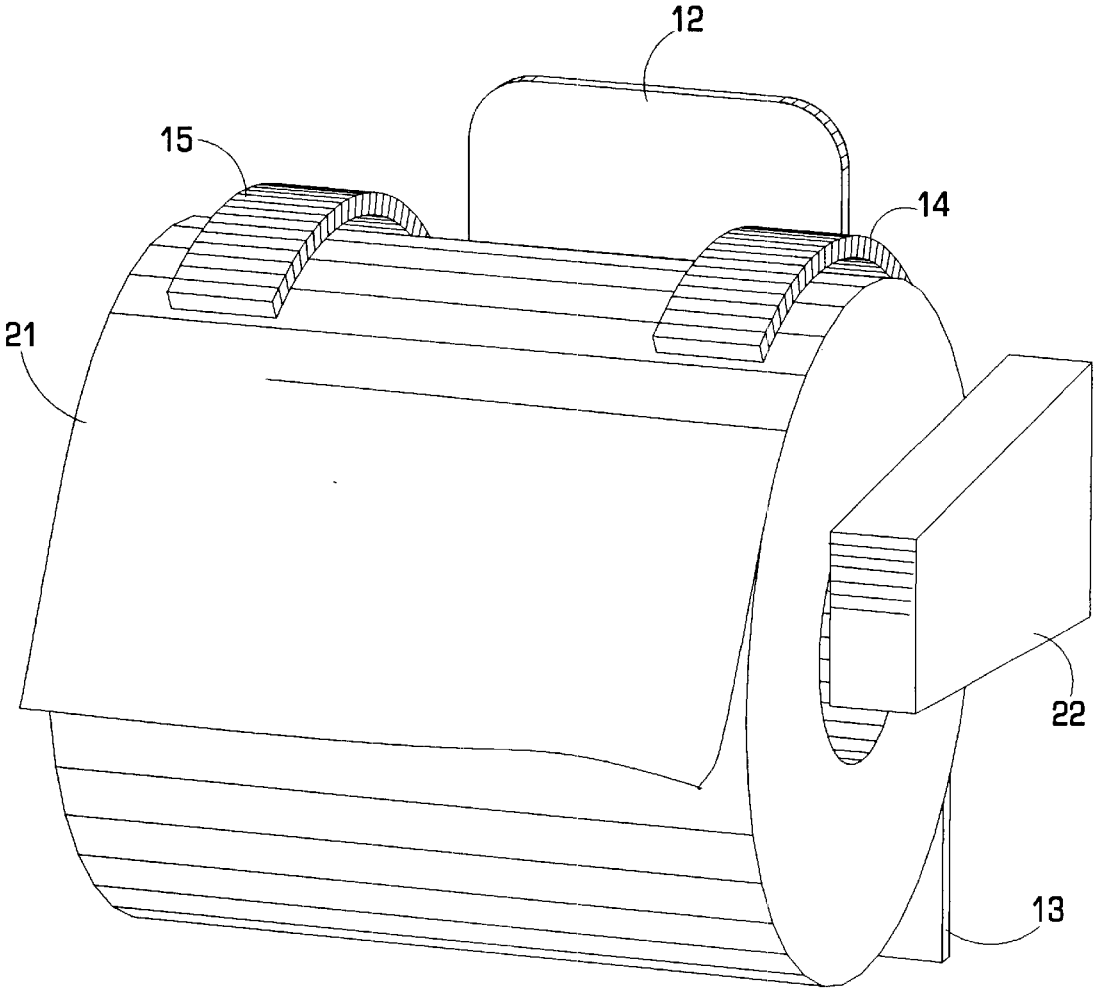
FIG. 2 is a perspective view showing the embodiment of FIG. 1, inserted into the space behind a toilet tissue roll.

In operation, this device is inserted behind a tissue roll, in the space between the tissue roll and the wall (not shown) where the tissue roll is mounted, as shown in FIG.2, wherein, in addition to the embodiment of FIG. 1, 21 is a tissue roll, and 22 is tissue roll mounting bracket. Left hook 15 and right hook 14 hang the device vertically onto tissue roll 21 with top anchorl2 on top and bottom anchor 13 on the bottom, and generate friction between the hooks 14, 15, and tissue roll 21. This friction remains constant even when the tissue roll gets smaller and smaller when it is gradually used up. Generally, when the tissue roll gets smaller, it is more likely to roll out of control. But the constant friction from the hooks 14 and 15 prevent this from happening.

The hooks 14 and 15 are disposed in the left and in the right instead of in the middle, to avoid blocking access of a user to the tissue.

Top anchor 12 and bottom anchor 13 are to prevent the device from rolling with the tissue roll 21 when the tissue is pulled. Without top anchor 12 and bottom anchor 13, the device can roll with tissue roll 21 and get out of its position and fall off. When rolling forward with the tissue roll 21, bottom anchor 13 will hit the wall (not shown). When rolling backward with the tissue roll 21, top anchor 12 will hit the wall (not shown). It is the wall (not shown), together with top anchor 12 and bottom anchor 13, that stops the rolling of the device.

Figure 3:
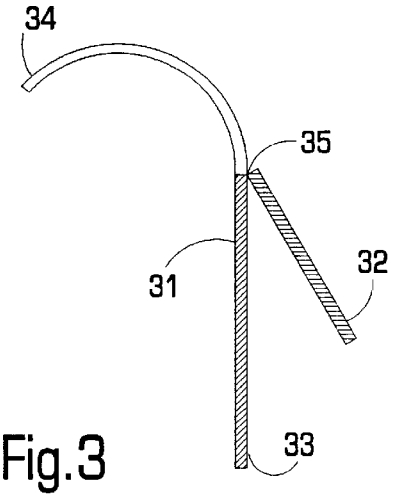
FIG. 3 is a sectional view showing an embodiment having a retractable top anchor.
Figure 4:
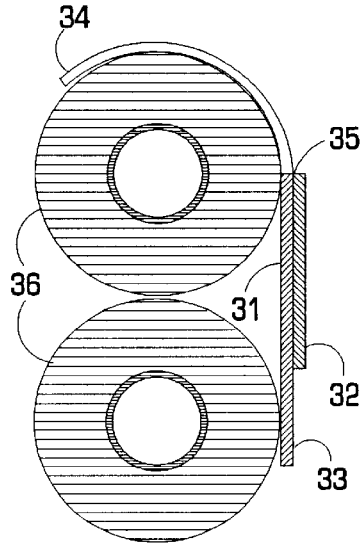
FIG. 4 is a sectional view showing the embodiment of FIG. 3, packaged with two tissue rolls, with top anchor retracted.
Figure 5:
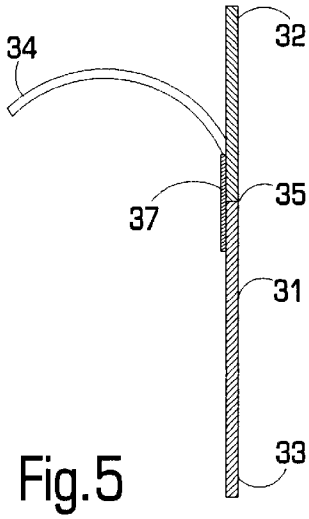
FIG. 5 is a sectional view showing the embodiment of FIG. 3, with top anchor fully extended to its operating position.

Sometimes it is desirable to package this device with tissue rolls for transportation and distribution. In order to do this, the top anchor has to be retractable. Otherwise the top anchor will protrude from the package. FIG. 3, FIG. 4, and FIG. 5 are cross sectional views showing an embodiment with a retractable top anchor. In FIG. 3, 31 is a main body, 32 is a retractable top anchor, 33 is a bottom anchor, 34 is a left hook, 35 is a hinge line of a thin area between retractable top anchor 32 and main body 31. As clearly shown in FIG. 3, retractable top anchor 32 flips back toward main body 31 along hinge line 35.

FIG. 4 shows an embodiment of FIG. 3, having a retracted top anchor, in package with a double tissue roll, wherein, in addition to the embodiment of FIG. 3, 36 is a double tissue roll. As clearly shown in FIG. 4, the retracted top anchor 32 is not protruding.

FIG. 5 shows an embodiment of FIG. 3, having a retractable top anchor flipped to its operating position, wherein, in addition to the embodiment of FIG. 3, 37 is an adhesive tape, to secure retractable top anchor 32 in a fully extended operating position.

Figure 6:
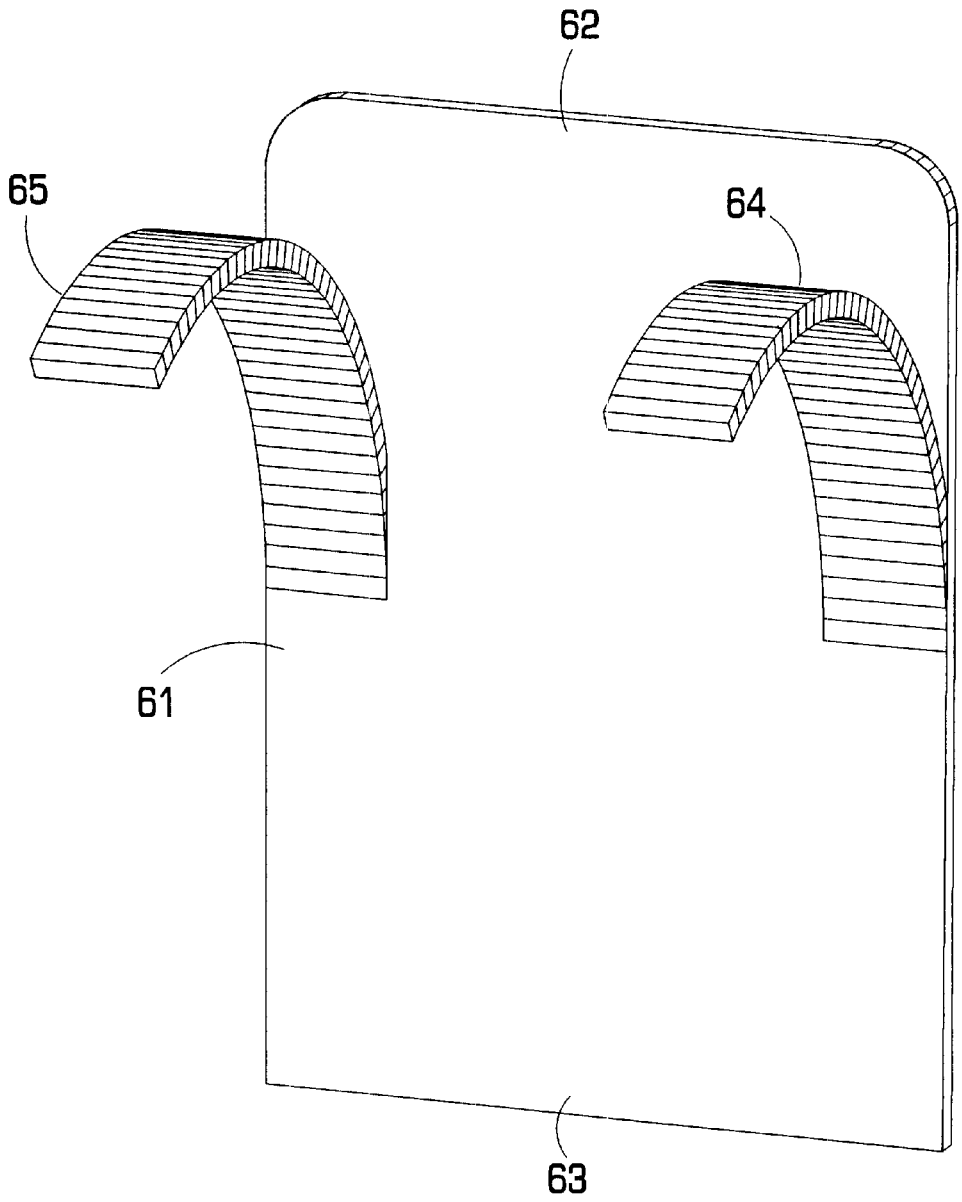
FIG. 6 is a perspective view of an embodiment of the invention having a full width top anchor

It is sometimes desirable to have a full width top anchor to prevent the device from swaying from side to side when inserted into the space behind a tissue roll. FIG. 6 in perspective view shows such an embodiment, wherein 61 is a main body, 62 is a fill width top anchor, 63 is a bottom anchor, 64 is a right hook, 65 is left hook. As indicted in FIG. 6, top anchor 62 assumes a same width as that of main body 61, and bottom anchor 63. The width of top anchor 62 is the width of the device.

While my above description contains many specificities, these should not be construed as limitations on the scope of the invention, but rather as an exemplification of a few preferred embodiments thereof. Many other variations are possible. Accordingly, the scope of the invention should be determined not by the embodiments illustrated, but by the appended claims and their legal equivalents.

What is claimed is:

1. A toilet tissue anti-roll insert comprising:

a) a main body mean;

b) a top anchor means mounted on one end of said main body means, to prevent said insert from rolling along backward with a toilet tissue roll;

c) a bottom anchor means mounted on the other end of said main body means, in opposition to said top anchor means, to prevent said insert from rolling along forward with said toilet tissue roll;

d) hook means mounted on said main body means in between said top anchor and said bottom anchor, to hang said anti-roll insert vertically onto said toilet tissue roll, so that said top anchor is on top and said bottom anchor is on the bottom.

2. A toilet tissue anti-roll insert as defined in claim 1, wherein said top anchor means is retractable into said main body means.

3. A toilet tissue anti-roll insert as defined in claim 1, wherein said top anchor means a assumes a full width of said toilet tissue anti-roll insert.

* * * * *